US007441431B2

(12) United States Patent
Weber et al.

(10) Patent No.: US 7,441,431 B2
(45) Date of Patent: Oct. 28, 2008

(54) HIGH SECURITY PIN TUMBLER LOCK

(75) Inventors: John L. Weber, San Rafael, CA (US); Marc W. Tobias, Sioux Falls, SD (US); George Yu, Petaluma, CA (US)

(73) Assignee: Micro Security Devices, Inc., San Rafael, CA (US)

( * ) Notice: Subject to any disclaimer, the term of this patent is extended or adjusted under 35 U.S.C. 154(b) by 0 days.

(21) Appl. No.: 11/651,244

(22) Filed: Jan. 9, 2007

(65) Prior Publication Data

US 2007/0157688 A1 Jul. 12, 2007

Related U.S. Application Data

(60) Provisional application No. 60/757,595, filed on Jan. 9, 2006.

(51) Int. Cl.
*E05B 27/00* (2006.01)

(52) U.S. Cl. ..... 70/491; 70/416

(58) Field of Classification Search ..... 70/491, 70/416, 418–421
See application file for complete search history.

(56) References Cited

U.S. PATENT DOCUMENTS

| | | | | |
|---|---|---|---|---|
| 541,630 | A | 6/1895 | Ridgway | |
| 1,851,986 | A * | 4/1932 | Rubsamen | 70/491 |
| 1,891,214 | A | 12/1932 | Falk | |
| 3,509,748 | A | 5/1970 | Trainor | |
| 3,524,335 | A | 8/1970 | George | |
| 3,541,819 | A | 11/1970 | Kerr | |
| 3,738,136 | A | 6/1973 | Falk | |
| 3,783,660 | A | 1/1974 | Gill | |
| 3,878,700 | A * | 4/1975 | Lopez | 70/491 |
| 3,903,720 | A | 9/1975 | Scherbing | |
| 4,069,696 | A | 1/1978 | Steinbach | |
| 4,078,405 | A * | 3/1978 | Steinbach | 70/491 |
| 4,112,820 | A | 9/1978 | Conger et al. | |
| 4,328,691 | A * | 5/1982 | Scherbing | 70/491 |
| 4,546,629 | A | 10/1985 | Hwang | |
| 4,653,297 | A | 3/1987 | Moorhouse | |
| 4,802,354 | A | 2/1989 | Johnson | |
| 4,831,852 | A | 5/1989 | Hughes | |
| 5,024,072 | A | 6/1991 | Lee | |
| 5,544,512 | A | 8/1996 | Shieh | |
| 6,584,819 | B1 | 7/2003 | Hung | |
| 6,718,808 | B2 | 4/2004 | Yu | |
| 7,150,168 | B1 * | 12/2006 | Kuo | 70/491 |
| 2007/0033975 | A1 * | 2/2007 | Liu | 70/491 |

* cited by examiner

*Primary Examiner*—Suzanne D Barrett
(74) *Attorney, Agent, or Firm*—Morgan Lewis & Bockius LLP

(57) ABSTRACT

A pin tumbler lock of a first embodiment includes a shell containing top pins; and a plug, rotatable within the shell, containing standard bottom pins, and a shorter bottom pin, set back from the face of the plug. A tubular key has bitings corresponding to the standard bottom pins, and a projection corresponding to the short bottom pin. When the key is inserted, the bitings and the projection press all the bottom pins to the shear line. In a second embodiment, a lock includes a shell containing top pins and a depression; and a plug, rotatable within the shell, containing bottom pins. The depression is configured and dimensioned to receive one of the bottom pins. The depression may be opposite one of the bottom pins, and there may be one more bottom pin than top pins. When the key is inserted, the bottom pins are moved to the shear line.

6 Claims, 3 Drawing Sheets

HIGH SECURITY PIN TUMBLER LOCK

CROSS-REFERENCE TO RELATED APPLICATION

This application claims priority to and the benefit of U.S. Provisional Application No. 60/757,595, filed on Jan. 9, 2006, the entire contents of which are incorporated herein by reference.

BACKGROUND OF THE INVENTION (a) Field of the Invention

The present invention relates to an axial pin tumbler lock, and more particularly to an axial pin tumbler lock that cannot be easily unlocked by impressioning.

(b) Description of the Related Art

Generally, an axial pin tumbler lock, also called a tubular lock, comprises 4-7 pin tumblers located around the circumference of a circle. The body of the key is tubular and the biting corresponding to each pin tumbler is cut out of the end.

A shear line lies between a rotatable plug and a fixed shell of the lock. Each biting on the key presses one bottom pin, which in turn presses a corresponding top pin. The top surface of the bottom pin and the bottom surface of the top pin are thus moved to the shear line. When ends of all pins lie along the shear line, the plug, along with the bottom pins, is free to rotate within the shell and the lock can be unlocked. However, if one or more of the top pins projects into the plug, or one or more of the bottom pins projects into the shell, rotation of the plug is blocked by the projecting pins.

Unlike linear pin tumbler locks, in which the key is inserted from front to back, depressing one pin at a time, in a tubular lock the key presses all the pins simultaneously. This renders impressioning of the lock, that is, forcing each bottom pin precisely to the shear line, much easier than picking or impressioning its linear counterpart.

For example, it has been demonstrated that conventional tubular locks can be opened in a few seconds with a plastic tube removed from a ball-point pen. When pressure is applied, the soft plastic of the tube deforms to fit the pin tumblers, mimicking the biting of the corresponding key. The tube can then be turned as the key would and the lock opened.

Conventional tubular locks can also be easily picked by bumping; that is, inserting a tube and applying a sudden force to the end of the tube, "bumping" the pins to the shear line.

U.S. Pat. No. 4,112,820 to Conger et al. discloses a special tumbler including a modified bottom pin with a relatively smaller diameter extension protruding in the direction of the key. The key has a small diameter pin at its forward end to register with and abut the pin extension to move the bottom pin to the shear line. However, because the smaller diameter extension of the modified bottom pin lies flush with the face of the plug, this lock can be easily "bumped."

The above information disclosed in this Background section is only for enhancement of understanding of the background of the invention and may contain information that does not form the prior art that is already known in this country to a person of ordinary skill in the art.

SUMMARY OF THE INVENTION

Embodiments of the present invention provide a tubular lock that cannot be easily impressioned or bumped.

A pin tumbler lock according to a first exemplary embodiment of the present invention includes a shell containing top pins; and a plug, rotatable within the shell, containing one or more standard bottom pins, and a relatively shorter bottom pin, set back from the face of the plug. A tubular key has bitings corresponding to the standard bottom pins, and a longer projection that corresponds to the short bottom pin. When the key is inserted in the lock, the bitings press the standard bottom pins, and the projection presses the short bottom pin, to the shear line. The key can then be turned and the lock opened.

In a second exemplary embodiment, an axial pin tumbler lock includes a shell containing one or more top pins and a depression; and a plug, rotatable within the shell, containing one or more bottom pins. The depression is configured and dimensioned to receive one of the bottom pins. The depression may be opposite one of the bottom pins, and there may be one more bottom pin than top pins. When the key is inserted in the lock, the bottom pins, including the one opposite the depression, are moved to the shear line. The key can then be turned and the lock opened.

DETAILED DESCRIPTION OF THE PREFERRED EMBODIMENTS

Figure 1:
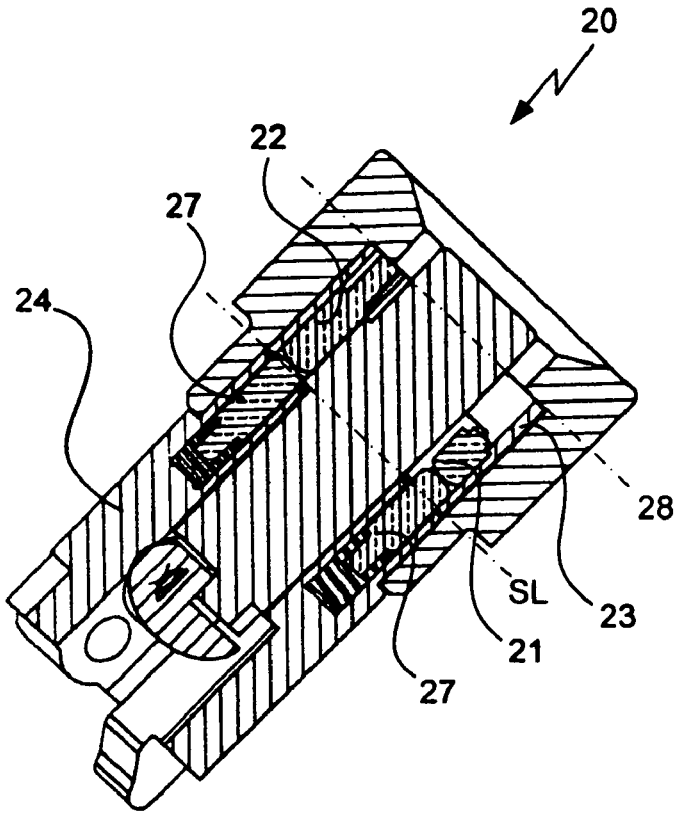
FIG. 1 is a sectional side view of a pin tumbler lock according to a first exemplary embodiment of the present invention with the key removed.
Figure 2:
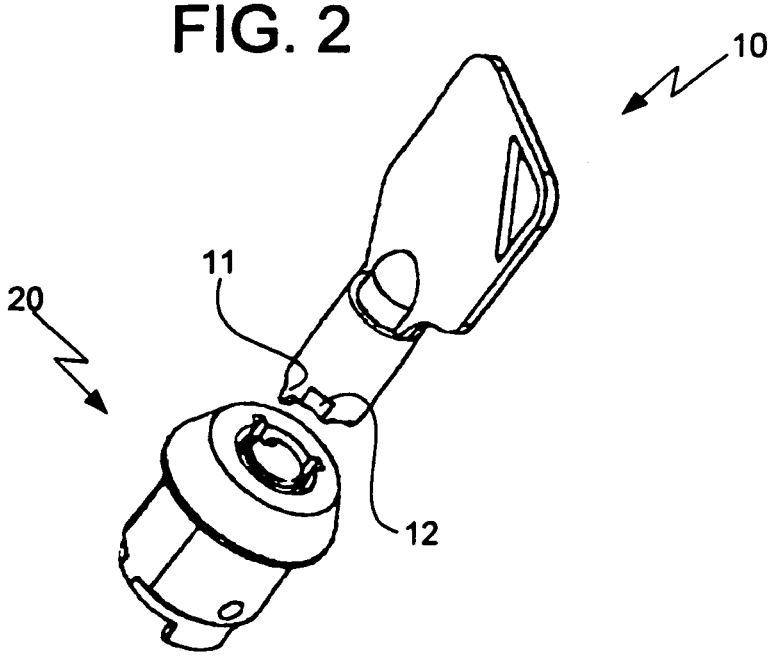
FIG. 2 is a perspective view of the lock of FIG. 1 and associated key.

Exemplary embodiments of the present invention will hereinafter be described in detail with reference to the accompanying drawings.

As shown in FIGS. 1-4, a first exemplary embodiment of the present invention provides a tubular key 10 comprising bitings 12 and a projection 11. Each key blank may be manufactured with the projection 11 before the bitings 12 are cut. The length of the projection 11 varies from key to key; that is, one of several possible lengths is assigned to each key 10 during manufacture. The position of the projection 11 also varies from key to key.

A lock 20 may include a shell 24 with a rotatable plug 23 disposed therein. Top pins 27 are disposed in the shell 24, each abutting a bottom pin 21, 22 disposed in the plug 23. While some of the bottom pins 22 have standard lengths, at least one bottom pin 21 is significantly shorter than the remainder of the bottom pins 22. The surface of the shortened bottom pin 21 that faces the key 10 is set back from the surface 28 of the plug 23; i.e. left of the surface 28 in FIGS. 1 and 3.

Figure 3:
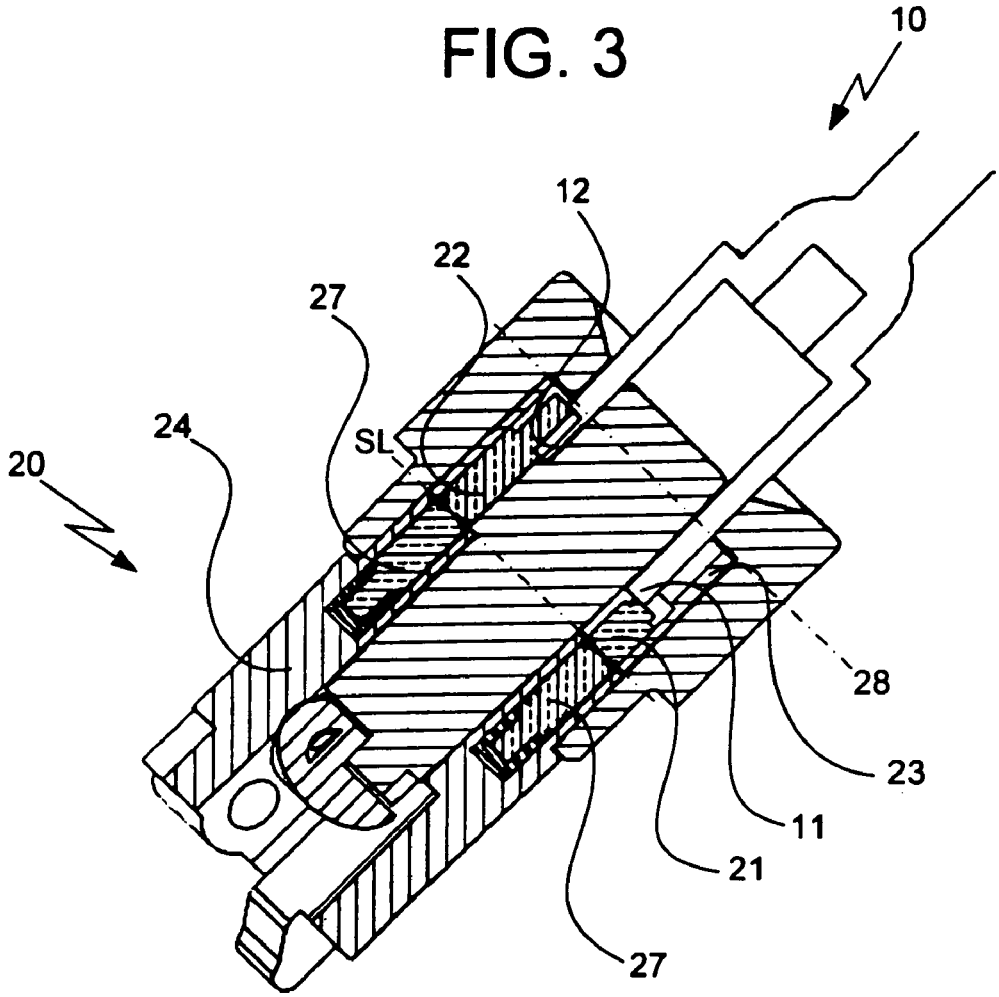
FIG. 3 is a sectional side view of the pin tumbler lock of FIG. 1 with the key inserted.
Figure 4:
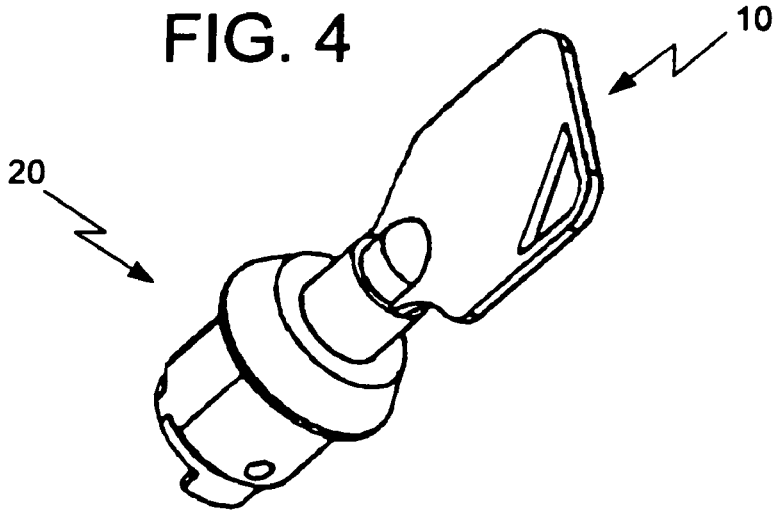
FIG. 4 is a perspective view of the lock and key of FIG. 3.

The lengths of the projection 11 and short bottom pin 21 are selected such that when the key 10 is inserted in the lock 20, as shown in FIGS. 3-4, the bitings 12 press the standard bottom pins 22 to the shear line SL, and the projection 11 presses the short bottom pin 21 to the shear line SL. The key 10 can then be turned, rotating the plug 23 within the shell 24, and opening the lock 20.

For example and without limitation, the length of the bitings 12, i.e. the length from where the biting is first recessed to the end of the key, may be approximately 2.0 mm. The projection 11 may protrude approximately 1.0 mm beyond the end of the key. The standard bottom pins 22 may be approximately 5.5 mm long, and the short bottom pin 21 may be approximately 2.5 mm long. These lengths may vary depending on the particular application and size of lock 20.

If a would-be thief attempts to impression or bump the first embodiment of the present invention, the impressioning or bumping tool (not shown) may press the standard bottom pins 22 such that their top surfaces reach the shear line. The short bottom pin 21, however, because it is distanced from the surface of the plug 23, is not pressed by the tool, and remains in its initial position as shown in FIG. 1. The top pin 27 that corresponds to the shortened bottom pin 21 thus remains projected into plug 23, bridging the shear line and preventing rotation of the plug 23.

Figure 5:
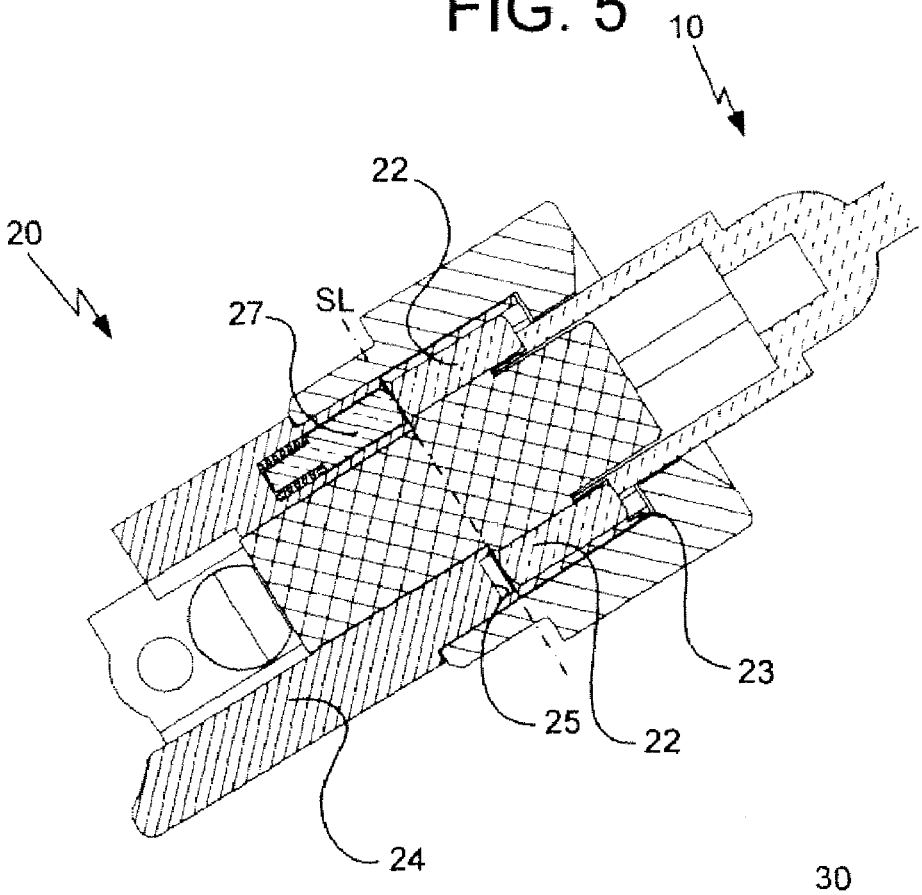
FIG. 5 is a sectional side view of a pin tumbler lock and key according to a second exemplary embodiment of the present invention with the key inserted.
Figure 6:
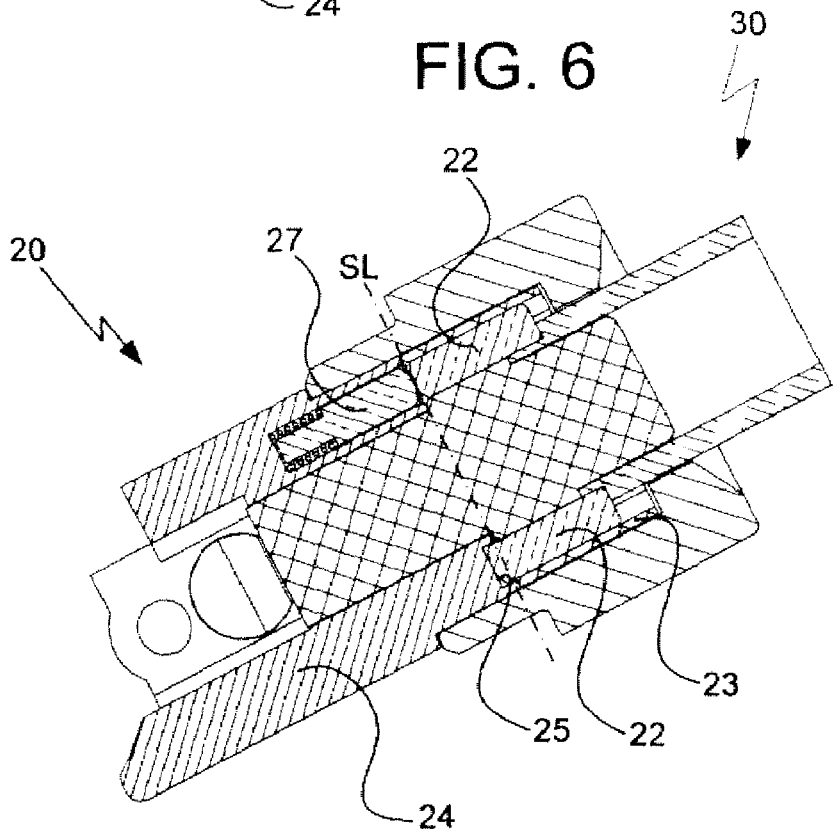
FIG. 6 is a sectional side view of the pin tumbler lock of FIG. 5 with an impressioning or bumping tool inserted.

As shown in FIGS. 5 and 6, in a second exemplary embodiment, the lock 20 includes one more bottom pin 22 than top pins 27. The shell 24 comprises a depression such as a blind hole 25, which may be opposite the extra bottom pin 22. When the key 10 is inserted, as shown in FIG. 5, the extra bottom pin 22 is pressed precisely to the shear line, and the lock 20 can be opened. When an impressioning or bumping tool 30, however, is inserted, as shown in FIG. 6, the bottom pin is pressed into the hole 25, bridging the shear line and preventing rotation of the plug 23.

The end of the extra bottom pin 22 may be substantially hemispherical, and the hole 25 may have a shape corresponding to the shape of the extra bottom pin 25. Because of the sloping surface of the hole 25, if the extra bottom pin 22 moves too far into the lock during opening with the key 10, it can slide out during turning, and be moved back to the shear line. During impressioning, however, the force imparted to the extra bottom pin 22 ensures that the pin 22 remains securely in the hole 25 and the plug 23 cannot be turned.

It should be understood, however, that the invention is not limited to the shape of the depression, nor is it limited to a blind hole 25. Any depression configured to receive a bottom pin 22, such as, without limitation, a through-hole, is suitable.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An axial pin tumbler lock, comprising:

a shell oriented around an axial direction;

a plurality of first pins disposed in the shell, each first pin comprising a first and a second end;

a rotatable plug disposed within the shell and comprising a surface substantially perpendicular to the axial direction; and at least one standard second pin and at least one relatively shorter second pin disposed within the rotatable plug, each second pin comprising a first end and a second end, the second end of the shorter second pin being distanced inwardly from the surface of the plug in the axial direction;

wherein the second end of each of the first pins contacts the first end of a respective one of the second pins in a locked state of the lock.

2. The lock of claim 1, wherein a length of the shorter second pin is less than about 80% a length of the standard second pins.

3. A key configured and dimensioned for insertion into the pin tumbler lock of claim 1, comprising:

one or more bitings, each configured and dimensioned to press a respective one of the standard second pins to a position corresponding to an opening state of the lock; and a projection protruding beyond an end of the key and configured and dimensioned to press the shorter second pin to a position corresponding to the opening state of the lock.

4. The key of claim 3, wherein the projection protrudes beyond the end of the key by a distance that is at least about 20% a length of the bitings.

5. An axial lock and cooperating, tubular key, configured for insertion into said lock, wherein:

the lock comprises a shell, a rotatable plug disposed within the shell with a surface facing the key during insertion of the key, and a plurality of pins disposed in the plug;

and the key comprises one or more bitings and a projection, configured and dimensioned such that, upon insertion of the key, the projection moves past the surface of the plug before contacting one of the pins.

6. The lock and key of claim 5, wherein the projection moves past the surface of the plug by a distance that is at least approximately 20% a length of the bitings before contacting one of the pins.

* * * * *